United States Patent [19]

Yorinks et al.

[11] 4,156,243

[45] May 22, 1979

[54] PARABOLOID REFLECTOR ANTENNA

[75] Inventors: Leonard H. Yorinks, Cherry Hill; Robert M. Scudder, Haddonfield, both of N.J.

[73] Assignee: RCA Corporation, New York, N.Y.

[21] Appl. No.: 842,080

[22] Filed: Oct. 14, 1977

[51] Int. Cl.[2] ..... H01Q 19/14

[52] U.S. Cl. ..... 343/779; 343/840

[58] Field of Search ..... 343/776, 777, 778, 779, 343/840, 854, 100 SA

[56] References Cited

U.S. PATENT DOCUMENTS

| | | | |
|---|---|---|---|
| 3,016,531 | 1/1962 | Tomiyasu et al. | 343/779 |
| 3,936,835 | 2/1976 | Phelan | 343/840 |
| 4,090,203 | 5/1978 | Duncan | 343/778 |

FOREIGN PATENT DOCUMENTS

| | | | |
|---|---|---|---|
| 814355 | 6/1959 | United Kingdom | 343/779 |

*Primary Examiner*—Eli Lieberman

*Attorney, Agent, or Firm*—H. Christoffersen; Joseph D. Lazar

[57] ABSTRACT

Eight radiators are disposed along a line in a vertical plane that intersects the focal point of a paraboloid reflector. When excitation is applied to a radiator, electromagnetic energy is transmitted therefrom to the reflector, thereby causing the reflector to reflect a beam at a selected elevation angle. Moreover, the beam is focused in azimuth. The beam is defocused in elevation in direct relation to its angle of elevation.

2 Claims, 16 Drawing Figures

PARABOLOID REFLECTOR ANTENNA

The Government has rights in this invention pursuant to Contract No. F30602-76-C-0290 awarded by the Department of the Air Force.

CROSS REFERENCE TO RELATED APPLICATIONS

Of interest is the following copending application: Ser. No. 842,079, filed on Oct. 14, 1977 entitled, "Antenna Feed System," based on the invention of Charles E. Profera.

BACKGROUND OF THE INVENTION

1. Field of the Invention

This invention relates to radar and more particularly to a radar that provides a beam which scans a spatial region and provides little spurious radiation.

2. Description of the Prior Art

In a military operation on land, it is usually desirable to have a radar that is mobile, light, small and thereby suitable for deployment near a battlefield. Moreover, spurious radiation from the antenna of the radar is preferably minimized to prevent destruction of the radar by radiation seeking missiles and to prevent interference caused by jammers. Spurious radiation is represented by side lobes in a radiation pattern of an antenna.

As known to those skilled in the art, much of the weight and bulk of the radar is in the antenna. A fixedly mounted antenna, such as a phased array antenna, usually includes a large number of components, thereby causing the phased array antenna to be heavy and bulky. Because of its weight and bulk, the phased array antenna is not suitable for deployment near the battlefield. An offset fed paraboloid reflector antenna has been considered for use with the radar because the paraboloid reflector antenna does not have the heavy weight and bulk of alternative types of antennas.

The paraboloid reflector antenna has been used on satellites. Typically, the paraboloid reflector antenna includes a plurality of radiators that are disposed near the focal point of the paraboloid reflector. The disposition of the radiators is selected to cause the propagation of a beam of electromagnetic energy to a known portion of the earth in response to excitation being applied to the radiators. Usually, the paraboloid reflector antenna is not symmetric with respect to the axis of the antenna, thereby preventing an occlusion of the beam by the radiators.

SUMMARY OF THE INVENTION

According to the present invention, a plurality of radiators are disposed in a vertical plane along a line that intersects the axis of a paraboloid reflector at the focal point thereof. A beam is reflected from the reflector in response to excitation being applied to a radiator. The angle between the line and the axis is selected to cause the reflected beam to be focused in azimuth.

DESCRIPTION OF THE PREFERRED EMBODIMENT

Figure 1:
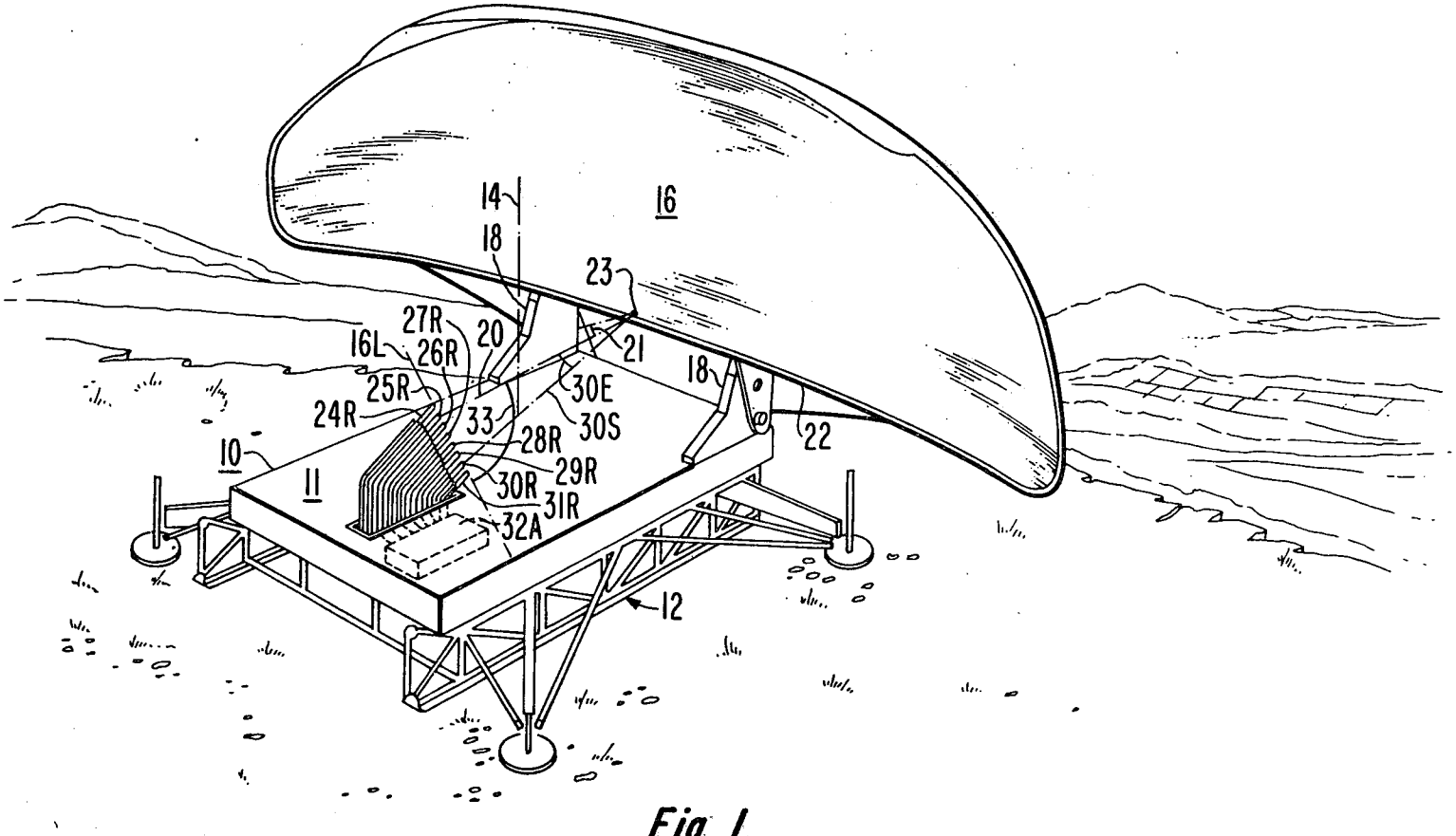
FIG. 1 is a perspective view of an antenna system in accordance with the preferred embodiment of the present invention.

As shown in FIG. 1, an antenna system is comprised of a platform 10 that is mounted upon a supporting structure 12 which rests upon the ground. Platform 10 has a surface 11 that is substantially parallel to the ground. Moreover, platform 10 is rotatable about an azimuth axis 14 which is substantially perpendicular to surface 11.

A generally elliptical paraboloid reflector 16 is fixedly connected by mounting brackets 18 to surface 11. Alternatively, reflector 16 may be connected to platform 10 in any other suitable manner.

Reflector 16 has an axis of revolution 20 that is displaced from surface 11 by an angle 21 which is approximately two degrees. Axis 20 intersects a lower edge 22 of reflector 16 at an intersection point 23. In an alternative embodiment, axis 20 does not intersect reflector 16.

Platform 10 carries radiators 24R–31R substantially within a vertical plane which contains axis 20. Radiators 24R–31R are fixedly disposed along a line 16L that passes through the focal point of reflector 16 which is located on axis 20. Line 16L forms an angle 33 with axis 20 in accordance with a relationship which is given as:

$$\phi = \text{arc-tan}\,\frac{4f}{y_1 + y_2} \qquad (1)$$

where $\phi$ is angle 33;

f is the focal length of reflector 16;

$y_1$ is a distance of axis 20 from a top edge of reflector 16; and $y_2$ is a distance of axis 20 from edge 22. In one particular antenna where $f=6.5$ feet, $y_1=12$ feet and $y_2=0$, angle 33 equals sixty six degrees.

When excitation is applied to any one of radiators 24R–31R, electromagnetic energy is transmitted therefrom to reflector 16. In response to the transmitted energy, a scan beam is reflected from reflector 16 whereby the transmitted energy is directed from the antenna system and propagated through a spatial region. Because radiators 24R–31R are disposed along line 16L, the scan beam is focused in azimuth. Moreover, the scan beam has a constant width in azimuth, independent of the elevation of the scan beam. Therefore, the radiation pattern of the antenna system has low side lobes is azimuth, independent of the elevation of the scan beam.

Since platform 10 is rotatable about axis 14, the azimuth of the scan beam may be selected by rotating platform 10. As explained hereinafter, the scan beam has a desired angle of elevation by applying excitation to a selected two of radiators 24R–31R.

Radiators 24R–31R are connected to a control unit 32A that applies excitation to radiators 24R–31R. Additionally, control unit 32A provides a target signal when a target reflects energy to the antenna system. Control unit 32A is described hereinafter in conjunction with a description of FIG. 2.

A line of sight 30S from radiator 30R to point 23, for example, subtends a radiator angle 30E with axis 20; angle 30E is below axis 20. Because of angle 30E, when the energy is transmitted by radiator 30R, the scan beam subtends an angle of elevation with axis 20 that is directly related to angle 30E. However, the angle of elevation of the scan beam is above axis 20.

Since radiators 24R–31R are disposed in the elevation plane, radiators 24R–31R subtend respective radiator angles that differ from each other. Accordingly, the scan beam has the desired angle of elevation when excitation is applied to a selected one of radiators 24R–31R.

Because radiators 26R–31R subtend radiator angles below axis 20 and axis 20 intersects edge 22, when the energy is transmitted by radiators 26R–31R, the scan beam is not occluded by radiators 24R–31R. Moreover, when the energy is transmitted by radiators 24R and 25R the occlusion is negligible. In one alternative embodiment, where the axis of the paraboloid reflector passes below its lower edge, there is no occlusion. In another alternative embodiment, when radiators are disposed below the axis of the paraboloid reflector, there is no occlusion.

It should be understood that there is a defocusing in elevation of the scan beam directly related to the angle of elevation of the scan beam. The defocusing is characterized by the scan beam being divergent in elevation. As known to those skilled in the art, when the scan beam diverges it is suitable for detecting a target within a large spatial region at a short range.

It should be appreciated that when there is a large angle of elevation of the target subtended from axis 20 by a line of sight from point 23 to the target, the target is usually at short range. Since the defocusing is directly related to the elevation angle of the scan beam, the target can be detected within a large region.

Figure 2:
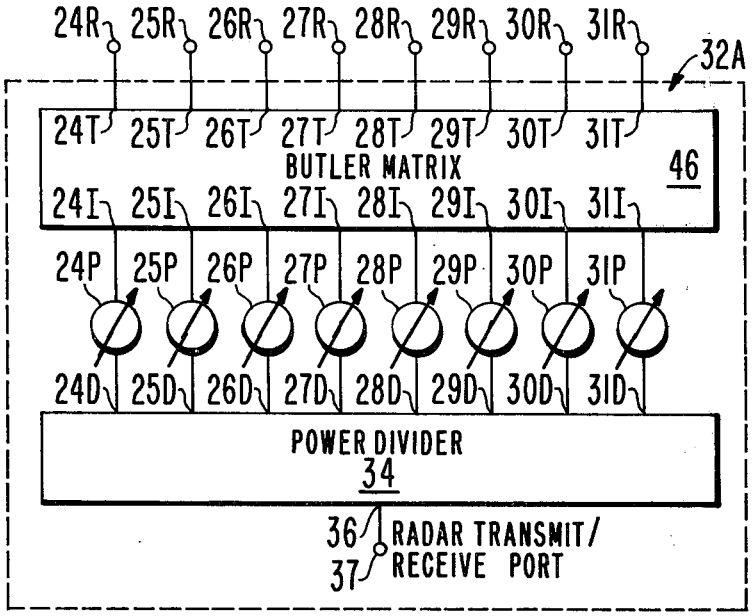
FIG. 2 is a schematic block diagram of apparatus for providing excitation to radiators in the embodiment of FIG. 1.

As shown in FIG. 2, to control the application of the excitation to radiators 24R–31R, control unit 32A includes a suitable power divider 34 that is connected to a radar (not shown) at a transmit/receive port 36 thereof. In response to a transmitted signal of the radar, a group of eight divider signals are provided by power divider 34 at divider ports 24D–31D thereof. Power divider 34 may be selected from any suitable type well known in the microwave art.

Figure 3:
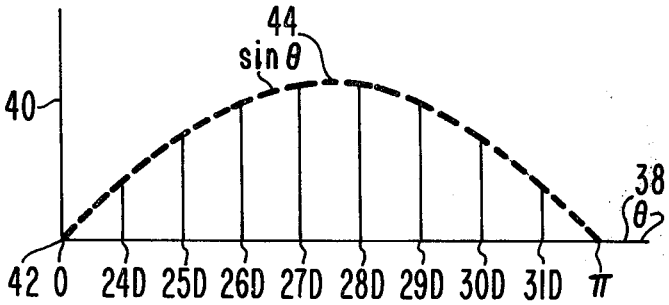
FIG. 3 is a graph of amplitudes of a group of inverse transform signals applied to a Butler matrix of FIG. 2.

As shown in FIG. 3, ports 24D–31D are represented as evenly spaced points along an abscissa 38 where the eight divider signals have amplitudes representative of values of a sinusoid within an angular range of zero radians to $\pi$ radians. Moreover, because of the symmetry of a sinusoid, the amplitudes of the divider signals at ports 24D and 31D equal each other. Similarly, the amplitudes of the divider signals equal each other at ports 25D and 30D, ports 26D and 29D and ports 27D and 28D.

It should be understood that power divider 34 is a linear, bilateral network. Therefore, when a group of signals is provided to ports 24D–31D, a corresponding signal is provided to transmit/receive port 36.

Ports 24D–31D are coupled to a Butler matrix 46 (FIG. 2) at inverse transform ports 24I–31I thereof through phase shifters 24P–31P, respectively. Additionally, Butler matrix 46 has transform ports 24T–31T that are connected to radiators 24R–31R, respectively.

In response to a signal representation of an inverse discrete Fourier transform being applied to ports 24I–31I, a signal representation of the discrete Fourier transform is provided at ports 24T–31T. Conversely, in response to the signal representation of the discrete Fourier transform being applied to ports 24T–31T, the signal representation of the inverse discrete Fourier transform is provided at ports 24I–31I. More particularly, signals at ports 24I–31I and ports 24T–31T are in accordance with a transform relationship which is given as:

$$b_n = \frac{1}{8} \sum_{m=24}^{31} a_m e^{j\phi(m,n)} \qquad (2)$$

where n is the reference number of an inverse transform port;

m is the reference number of a transform port;

$b_n$ is the amplitude of a signal at the inverse transform port having the reference number, n;

$a_m$ is the amplitude of a signal at the transform port having the reference number, m;

$$\phi(m,n) = \delta_m (n - 23 - \frac{9}{2}); \text{ and}$$

$$\delta_m = \frac{\pi}{4} (\frac{9}{2} - m - 23)$$

As explained hereinafter, it is desired that the signals at ports 24I–31I (referred to as inverse transform signals) be respectively equal in amplitude to the group of divider signals at ports 24D–31D. When the inverse transform signals are equal in amplitude to the divider signals, excitation is simultaneously applied to two adjacent ones of radiators 24R–31R. Moreover, the two adjacent ones of radiators 24R–31R are selected for excitation by a selection of phases of the inverse transform signals.

Phase shifters 24P–31P, referred to hereinbefore, are connected to a computer (not shown) that provides a signal representation of a selected two adjacent ones of radiators 24R–31R. Phase shifters 24P–31P are of a type that provides a signal that has an amplitude substantially equal to the amplitude of an input signal applied thereto. Moreover, the signals provided by phase shifters 24P–31P and input signals applied thereto have respective phase differences in accordance with the signal representation. In response to the divider signals and the signal representation, phase shifters 24P–31P provide the inverse transform signals to Butler matrix 46.

It should be understood that phase shifters 24P–31P are reciprocal networks. Accordingly, when Butler matrix 46 applies signals to phase shifters 24P–31P, signals are provided to ports 24D–31D that are equal in amplitude to signals at ports 24I–31I, respectively. However, the signals at ports 24D–31D and ports 24I-

-31I always have respective phase differences therebetween in accordance with the signal representation.

According to the present invention, when the signals provided at ports 24I-31I have amplitudes substantially equal to the amplitudes of the transmitted divider signals at ports 24D-31D, respectively, excitation is applied to radiators 24R-31R in accordance with a first transform relationship which is given as:

$$a_m = \left(\frac{\pi}{2}\right)^2 \frac{\cos \phi\,(m,n)}{\left(\frac{\pi}{2}\right)^2 - (\phi\,(m,n))^2} \quad (3)$$

Figure 4:
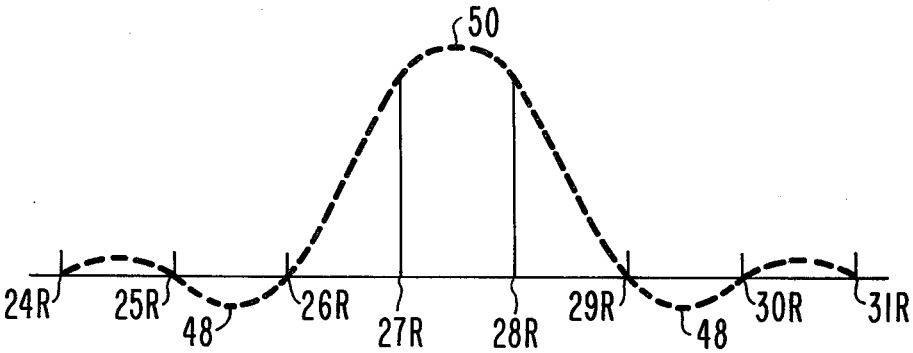
FIG. 4 is a graph of the amplitude of excitation provided to radiators of FIG. 1 when the inverse transform signals are cophased.

As shown in FIG. 4, when the signals at ports 24D-31D are cophased, according to the first transform relationship (3) excitation is applied to radiators 27R and 28R; no excitation is applied to radiators 24R, 25R, 26R, 29R, 30R and 31R because they correspond to nulls of the first transform relationship (3).

Figure 5A:
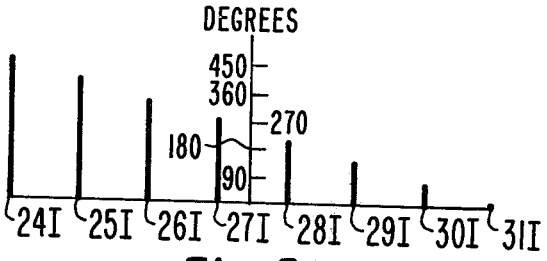
FIGS. 5A–5F are graphs of the phases of the inverse transform signals that are applied to the Butler matrix of FIG. 2.
Figure 5D:
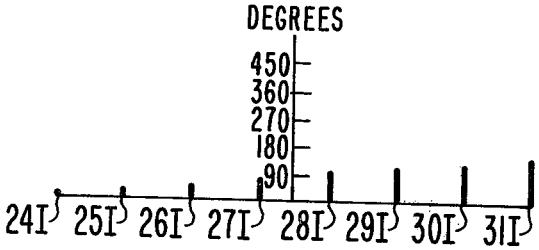

In a similar manner, when phase shifters 24P-31P provide phase shifts in accordance with FIG. 5A, excitation according to the first transform relationship (3) is applied to radiators 24R and 25R; phase shifts that cause excitation to be applied to other pairs of radiators 24R-31R are shown in FIGS. 5B-5F. A tabulation that relates the phase shifts as shown in FIGS. 5A-5F to the application of excitation of radiators 24R-31R (according to the first transform relationship (3)) is provided in Table I, which is given hereinafter.

TABLE I

| PHASE SHIFT | REFERENCE NUMBER OF RADIATOR WHERE EXCITATION IS APPLIED |
|---|---|
| 5A | 24R, 25R |
| 5B | 25R, 26R |
| 5C | 26R, 27R |
| COPHASED | 27R, 28R |
| 5D | 28R, 29R |
| 5E | 29R, 30R |
| 5F | 30R, 31R |

It should be understood that the scan beam provides a stepped scan in elevation of a spatial region when the phase shifts are sequentially changed in the order set forth in Table I. The spatial region corresponds to the elevation sector where radiators 24R-31R are disposed.

Figure 5B:
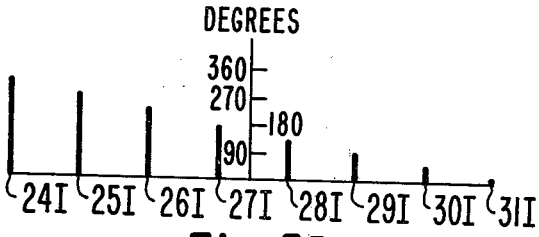
Figure 5E:
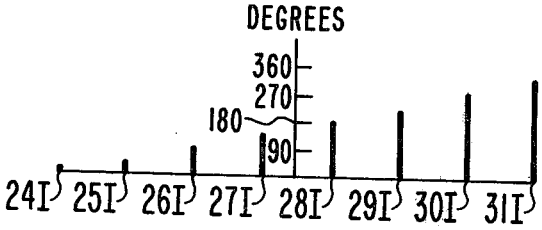
Figure 5C:
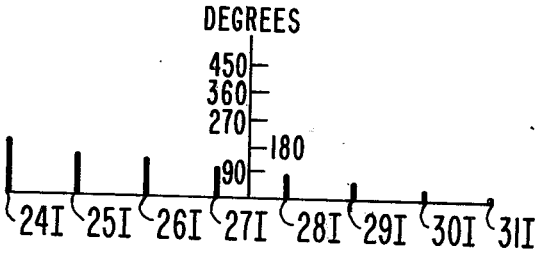
Figure 5F:
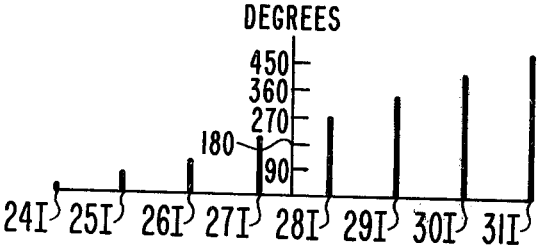

It may not be possible to provide a discrete change from the phase pattern of FIG. 5A to the phase pattern of FIG. 5B, for example. When the discrete change is not provided, there is a spurious excitation applied to one of the radiators 24R-31R.

The spurious excitation is understood by noting that peak points 48 (FIG. 4) are representative of an amplitude that is 23 db lower than an amplitude represented by peak point 50. Accordingly, when the discrete change is not provided, a spurious excitation of one of the radiators 24R-31R is at least 23 db lower than the peak excitation applied to radiators 24R-31R. Because the spurious excitation is 23 db lower than the peak excitation, the spurious excitation is tolerable.

Figure 6:
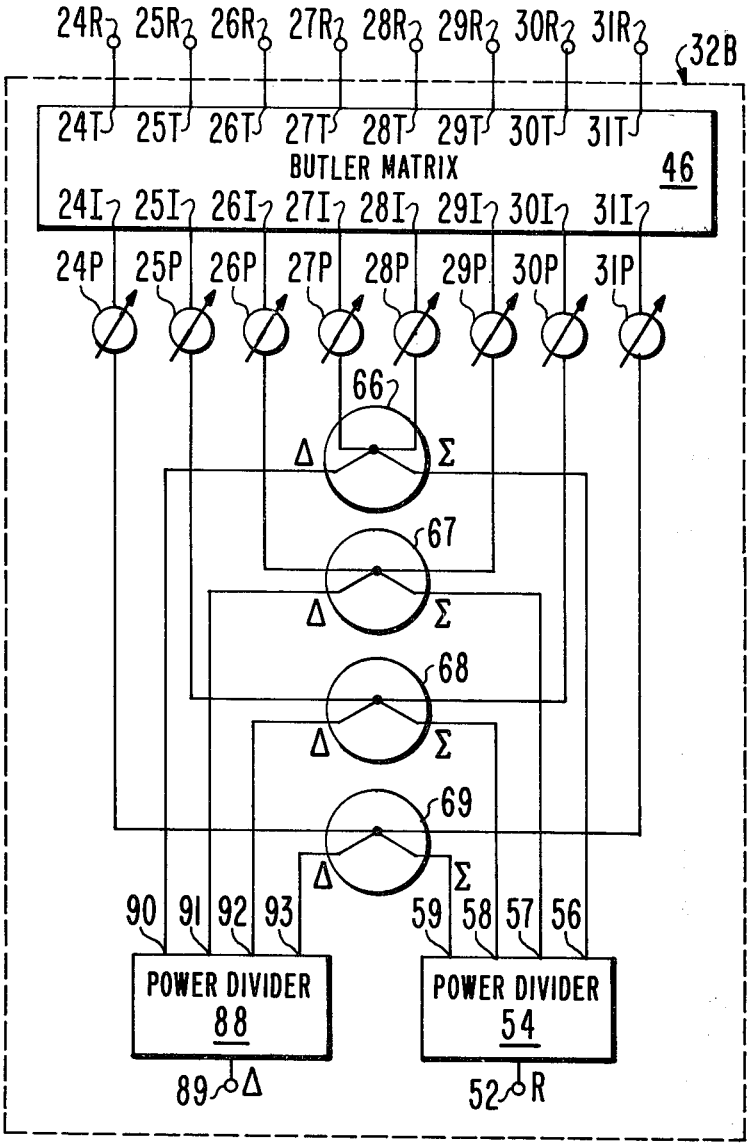
FIG. 6 is a schematic block diagram of apparatus that is used to provide a monopulse operation of the antenna system of FIG. 1.

As shown in FIG. 6, in another form of the preferred embodiment, a reference channel of a monopulse radar (not shown) is connected to a control unit 32B at a reference port 52 thereof. Within control unit 32B, port 52 is connected to a power divider 54. In response to a transmitted signal from the monopulse radar, a group of reference channel signals are provided by power divider 54 at ports 56-59 thereof. Similar to power divider 34, (FIG. 2) power divider 54 is a linear, bilateral network, whereby signals provided to ports 56-59 cause a corresponding signal to be provided at port 52.

Figure 7:
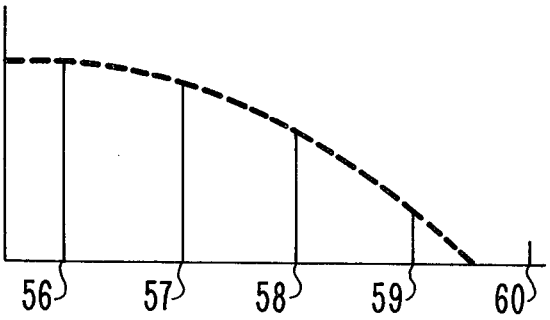
FIG. 7 is a graph of a transfer characteristic of a first power divider in the apparatus of FIG. 6.

As shown in FIG. 7, ports 56-59 are represented as evenly spaced points along an abscissa 60 where the reference channel signals have amplitudes representative of values of a sinusoid within an angular range of $\pi/2$ radians to $\pi$ radians.

Ports 56-59 are coupled to phase shifters 24P-31P through magic TEE networks 66-69, respectively. As known to those skilled in the art, signals at sum and difference ports of a magic TEE are respectively proportional to the sum and the difference of signals at a pair of signal ports of the magic TEE.

When, for example, a signal is provided to the sum port of the magic TEE, cophased signals of equal amplitude are provided at the signal ports thereof. Correspondingly, when cophased signals of equal amplitude are provided to the signals ports, a signal is provided at the sum port; no signal is provided at the difference port.

The sum ports of magic TEEs 66-69 are connected to ports 56-59, respectively. The signal ports of magic TEEs 66-69 are respectively connected to phase shifters 27P and 28P, phase shifters 26P and 29P, phase shifters 25P and 30P, and phase shifters 24P and 31P. Because of the symmetry of a sinusoid, in response to the reference channel signals, magic TEEs 66-69 provide signals to phase shifters 24P-31P that have amplitudes substantially equal to the amplitudes of the divider signals described hereinbefore in connection with FIGS. 2 and 3. Accordingly, phase shifters 24P-31P and magic TEEs 66-69 are operable to provide inverse transform signals to Butler matrix 46 similar to those described in connection with FIGS. 2 and 3.

Figure 8:
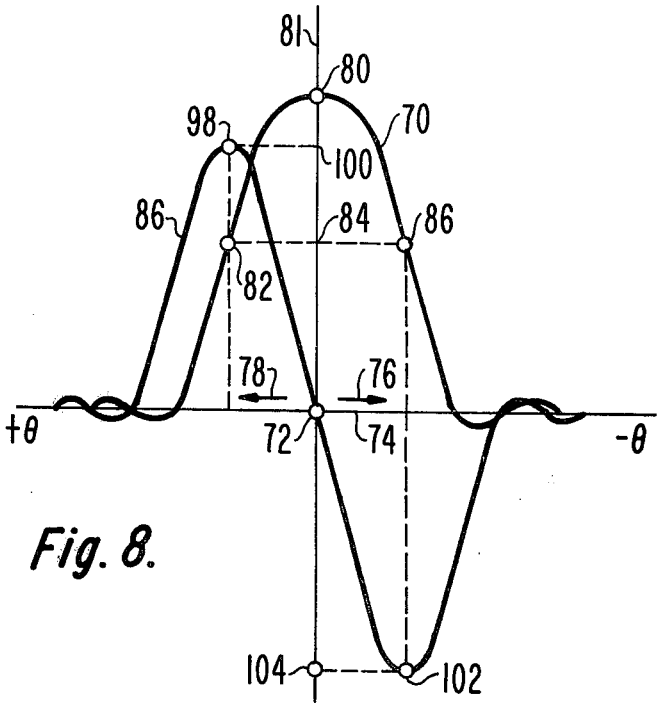
FIG. 8 is a graph of far field patterns that are produced by the apparatus of FIG. 6 when operating with the reflector of the antenna system of FIG. 1.

As shown in FIG. 8, when, for example, the energy is simultaneously transmitted from radiators 27R and 28R, an electric field that radiates from the antenna system has a far field represented by a reference pattern 70. Pattern 70 is in a coordinate system where a displacement from an origin 72 along an abscissa 74 is representative of an error angle. The error angle is subtended at point 23 (FIG. 1) from a line of sight that extends midway between the central axes of exemplary scan beams that are reflected from reflector 16 in response to the energy being transmitted by radiators 27R and 28R. Spatial locations along the line midway between the central axes are equally irradiated by each of the exemplary scan beams.

A peak point 80 of pattern 70 on ordinate 81 of the coordinate system has an abscissa equal to zero. Peak point 80 is representative of the strength of the electric field at locations midway between the central axes of the exemplary scan beams. Since phase shifters 24P-31P are reciprocal networks and Butler matrix 46, power divider 54, and magic TEEs 66-69 are linear bilateral networks, when the target reflects equal amounts of energy to radiators 27R and 28R, a reference channel return signal corresponding to peak point 80 is provided at terminal 52. It should be understood that all energy reflected from the target to radiators 24R-31R is via a reflection from reflector 16 (FIG. 1).

Correspondingly, a point 82 on pattern 70 has an abscissa representative of a positive error angle. Point 82 is representative of the strength of the electric field at locations where substantially all of the energy directed from the antenna system is provided by radiator 27R. Accordingly, when the target reflects energy to radiator 27R (and reflects substantially no energy to radiator 28R), a target signal having an amplitude corresponding to a point 84 on ordinate 81 is provided at terminal 52. It should be understood that points on pattern 70 that have an abscissa between the abscissa of point 82 and origin 72 are representative of field strengths of the electric field at locations where radiator 27R provides more energy than radiator 28R.

In a similar manner, a point 86 on pattern 70 has an abscissa representative of a negative error angle. Point 86 is representative of the strength of the electric field at locations where substantially all of the energy directed from the antenna system is provided by radiator 28R. Accordingly, when the target reflects energy to radiator 28R (and reflects substantially no energy to radiator 27R), a reference channel return signal having an amplitude corresponding to point 84 is provided at port 52. It should be understood that points on pattern 70 that have an abscissa between the abscissa of point 86 and origin 72 are representative of strengths of the electric field at locations where radiator 28R provides more energy than radiator 27R.

The antenna system radiates electric fields, corresponding to the field represented by pattern 70, in response to the application of excitation to each pair of adjacent ones of radiators 24R–31R. From the explanation given hereinbefore, power divider 54, magic TEEs 66–69, phase shifters 24P–31P and Butler matrix 46 are operable as a monopulse radar reference channel feed.

The difference port of magic TEEs 66–69 are connected to a power divider 88 at ports 90–93 thereof, respectively. An output terminal of power divider 88 is connected to a difference port 89 of control unit 32B. In response to a hypothetical signal being applied at port 89, a group of four divider signals are provided at ports 90–93. Power divider 88, similar to power dividers 34 and 54, is a linear, bilateral network whereby signals provided to ports 90–93 cause a corresponding signal to be provided to port 89. As explained hereinafter, power divider 88, magic TEEs 66–69, phase shifters 24P–31P and Butler matrix 46 are operable as a monopulse radar difference channel feed.

Figure 9:
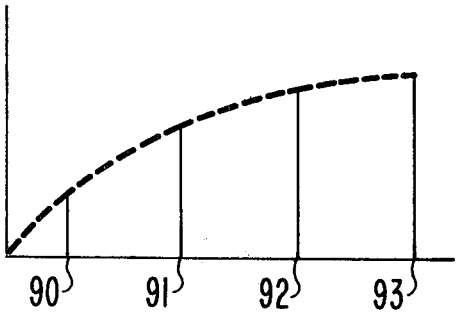
FIG. 9 is a graph of a transfer characteristic of a second power divider in the apparatus of FIG. 6.

As shown in FIG. 9, ports 90–93 are represented as evenly spaced points along an abscissa 94. In accordance with FIG. 9, the four divider signals have amplitudes representative of values of a sinusoid within an angular range of zero radians to $\pi$ radians. In response to the four divider signals, magic TEEs 66–69 provide difference channel signals to phase shifters 24P–31P.

Figure 10:
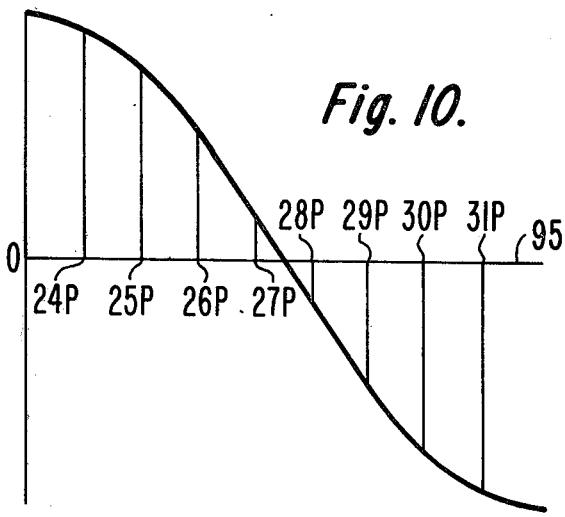
FIG. 10 is a graph of the amplitude of signals provided in a difference channel of the apparatus of FIG. 6.

As shown in FIG. 10, phase shifters 24P–31P are represented as evenly spaced points along an abscissa 95. According to FIG. 10, the difference channel signals are representative of values of a sinusoid within an angular range of $-\pi/2$ radians to $\pi/2$ radians. In response to the difference channel signals, excitation is applied to radiators 24R–31R in accordance with a second transform relationship which is given as:

$$a_m = \frac{\phi(m,n)\cos\phi(m,n)}{(\frac{\pi}{2})^2 - \phi(m,n)^2} \quad (4)$$

Figure 11:
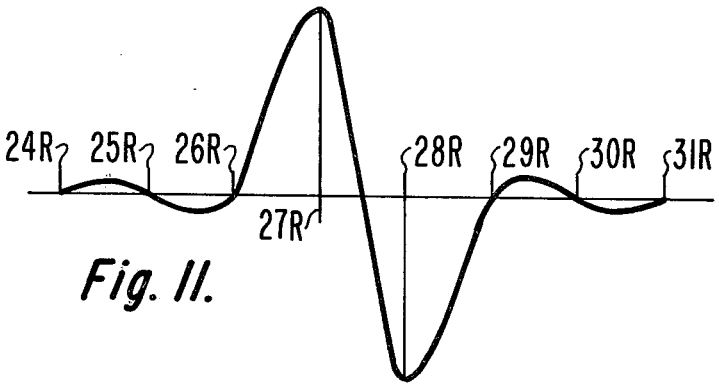
FIG. 11 is a graph of the amplitude of excitation applied to radiators of FIG. 1 in response to signals in accordance with FIG. 10 that are applied to the difference channel of the apparatus of FIG. 6.

As shown in FIG. 11, when phase shifters 24P–31P do not cause phase shifts of the difference channel signals, excitation of equal amplitude and opposite phase is applied to radiators 27R and 28R in accordance with the second transform relationship (4); no excitation is applied to radiators 24R, 25R, 26R, 29R, 30R and 31R because they correspond to nulls of the second transform relationship (4). The tabulation in Table 1 relates the phase patterns of FIGS. 5A–5F to the application of excitation to radiators 24R–31R in accordance with the second transform relationship (4).

As shown in FIG. 8, when excitation of equal amplitude and opposite phase is applied to radiators 27R and 28R, an electric field that radiates from the antenna system has a far field represented by a difference pattern 96. It should be appreciated that pattern 96 passes through origin 72. Since power divider 88 is a linear bilateral network, and pattern 96 passes through point 72, when the target reflects equal amounts of energy to radiators 27R and 28R, no signal is provided at port 89.

A point 98 of pattern 96 has an abscissa which is the same as the abscissa of point 82 referred hereinbefore. Accordingly, when the target reflects energy to radiator 27R (and reflects no energy to radiator 28R) an error signal having an amplitude corresponding to a point 100 on ordinate 81 is provided at terminal 89. Analogous to pattern 70, points on pattern 96 that have an abscissa between the abscissa of point 98 and origin 72 are representative of error signals that are provided in response to a target signal reflecting more energy to radiator 27R than to radiator 28R.

In a similar manner, a point 102 on pattern 96 has an abscissa which is the same as the abscissa of point 86.

What is claimed is:

1. A paraboloid reflector antenna, comprising:

a paraboloid reflector having an axis of revolution and a focal point on said axis, said reflector having a bottom edge and a top edge, and said axis lying in a vertical plane;

a plurality of radiators disposed and lying in said vertical plane along a straight line that intersects said axis at said focal point, said axis and said line having an angle therebetween that causes beams of energy transmitted from any adjacent pair of said radiators to be reflected from said radiator so as to be focused at a selected elevation in said vertical plane.

2. The antenna of claim 1 wherein said angle is in accordance with a relationship which is given as:

$\phi = \arctan 4f/y_1 + y_2$ where $\phi$ is said angle;

f is the focal length of said reflector;

$y_1$ is the distance of said top edge of said reflector from said axis; and $y_2$ is the distance of said bottom edge of said reflector from said axis.

* * * * *